US006595377B1

(12) United States Patent
Hetu

(10) Patent No.: US 6,595,377 B1
(45) **Date of Patent: *Jul. 22, 2003**

(54) TREE-SHAPED POTTED PLANT HOLDER

(76) Inventor: Thelma Hetu, Box 559, Leask, Saskatchewan (CA), S0J 1M0

( * ) Notice: Subject to any disclaimer, the term of this patent is extended or adjusted under 35 U.S.C. 154(b) by 0 days.

This patent is subject to a terminal disclaimer.

(21) Appl. No.: 10/085,651

(22) Filed: Feb. 28, 2002

(51) Int. Cl.[7] ..... A47F 5/00

(52) U.S. Cl. ..... 211/85.23; 211/196; 211/208; 248/156; 248/315; D6/405; 47/39

(58) Field of Search ..... 211/205, 163, 211/196, 85.23, 208; 248/156, 315, 161, 408; D6/405; 47/39

(56) References Cited

U.S. PATENT DOCUMENTS

| | | | | | |
|---|---|---|---|---|---|
| 670,144 | A | * | 3/1901 | Bond | |
| 1,797,077 | A | * | 3/1931 | Dew et al. | |
| 3,018,898 | A | * | 1/1962 | Frazelle | |
| 3,169,742 | A | * | 2/1965 | Smith | |
| 3,310,180 | A | * | 3/1967 | Neagle | |
| 3,991,686 | A | | 11/1976 | Mechachonis | 108/28 |
| D244,571 | S | * | 6/1977 | Cowan | |
| 4,068,761 | A | | 1/1978 | McCarthy | 211/134 |
| 4,181,230 | A | * | 1/1980 | Acuff | 211/208 |
| 4,757,641 | A | * | 7/1988 | Penrod | 47/39 |
| 4,770,303 | A | | 9/1988 | Boyd | 211/205 |
| D300,699 | S | * | 4/1989 | Penrod | D6/405 |
| 4,991,344 | A | | 2/1991 | Carney | 47/39 |
| 5,114,022 | A | | 5/1992 | Rood | 211/71 |
| 5,450,692 | A | | 9/1995 | Ruibal | 47/83 |
| 5,487,476 | A | | 1/1996 | Barfield | 211/71 |
| D401,484 | S | | 11/1998 | Hardison | D8/1 |
| 5,934,014 | A | | 8/1999 | Carrothers | 47/39 |
| D435,177 | S | * | 12/2000 | Buell et al. | D6/403 |

* cited by examiner

*Primary Examiner*—Robert W. Gibson, Jr.
(74) *Attorney, Agent, or Firm*—Sturm & Fix LLP

(57) ABSTRACT

A tree-shaped potted plant holder (10) including an adjustable length main support unit (11) that comprises an upper tubular support member (30) that is rotatably and telescopically received within a lower tubular support member (20); wherein, both the upper (30) and lower (20) tubular support members are provided with rows (33) (34) and (26) of horizontally arrayed apertures that are dimensioned to receive a plurality of different length support arm members (40) each provided with a split ring pot receiving element (43); and, wherein, the lower tubular support member (20) is further provided with a stabilizing unit (13) for maintaining the main support unit (11) in a vertically upright position.

11 Claims, 1 Drawing Sheet

TREE-SHAPED POTTED PLANT HOLDER

BACKGROUND OF THE INVENTION

1. Field of the Invention

The present invention relates to the field of support structures for potted plants and in particular to a potted plant holder.

2. Description of Related Art

As can be seen by reference to the following U.S. Pat. Nos. DES 345,871; 5,450,692; 4,068,761; 5,487,476; and 4,770,303, the prior art is replete with myriad and diverse multi-armed potted plant holders that are designed to accommodate a plurality of potted plants in an aesthetically pleasing fashion.

While all of the aforementioned prior art constructions are more than adequate for the basic purpose and function for which they have been specifically designed, they are uniformly deficient with respect to their failure to provide a simple, efficient, and practical potted plant holder having a number of functional features that are neither taught nor suggested by the above mentioned patents.

As any gardener or plant lover is all too well aware, most stationary potted plant holders have somewhat limited usage simply by virtue of their stationary nature which does not permit the rotation of the supported potted plants so that each potted plant receives generally the same amount of exposure to sunlight over a period of time.

In addition, there are many instances wherein a given stationary potted plant support device is simply too tall for a given location and therefore useless for its intended purpose.

As a consequence of the foregoing situation, there has existed a longstanding need among gardeners and plant lovers for a new and improved potted plant holder that incorporates the features of vertical adjustability and relative rotation into its design and construction; and, the provision of such an arrangement is the stated objective of the present invention.

BRIEF SUMMARY OF THE INVENTION

Briefly stated, the tree shaped potted plant holder that forms the basis of the present invention comprises in general an adjustable height main support unit, a plurality of potted plant support units and a stabilizing unit.

As will be explained in greater detail further on in the specification, the main support unit comprises an upper tubular support member that is rotatably and telescopically received in a lower tubular support member wherein both the upper and lower tubular support members are adapted to receive the plurality of potted plant support units which come in different lengths so as to produce a generally tree-shaped configuration for the assembled potted plant holder.

In addition, each of the plurality of potted plant support units include a generally rigid support arm member having an outboard end provided with a split ring pot receiving element having a side opening that can be expanded and retracted to accommodate potted plants having different circumferences.

Furthermore, the stabilizing unit includes a plurality of stabilizing rod members that project outwardly from the lower tubular support member to maintain the main support unit in a vertically upright position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
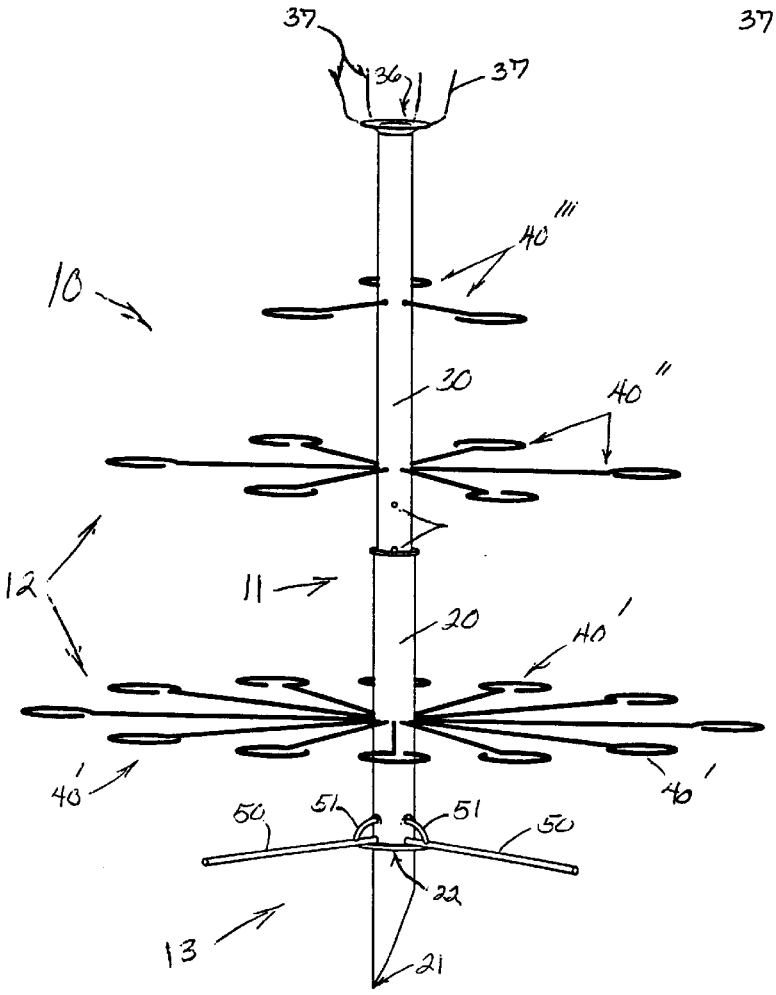
FIG. 1 is a perspective view of the tree-shaped plant holder that forms the basis of the present invention.

As can be seen by reference to the drawings, and in particular to FIG. 1, the tree-shaped potted plant holder that forms the basis of the present invention is designated generally by the reference number (10). The potted plant holder 10 comprises in general a vertically adjustable support unit 11, a plurality of potted plant support units 12 and a stabilizing unit 13. These units will now be described in seriatim fashion.

Figure 2:
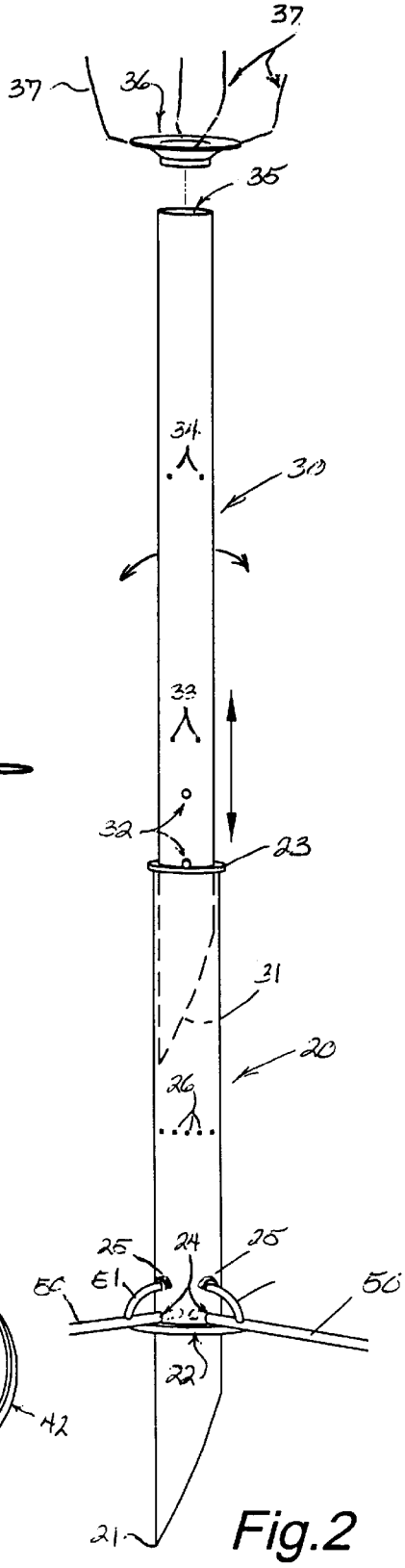
FIG. 2 is an isolated detail view of the main support unit and a portion of the stabilizing unit.

As shown in FIGS. 1 and 2, the main support unit 11 comprises a pair of hollow tubular main support members 20 and 30 including an enlarged lower tubular support member 20 and a narrower upper tubular support member 30 that is dimensioned to be slidably received within the lower tubular support member 20.

As can best be appreciated by reference to FIG. 2, the lower tubular support member 20 has a tapered bottom end 21 designed to penetrate the earth, a flanged collar 22 disposed proximate to, but spaced from, the bottom end 21 and an upper end provided with a flanged lip 23.

In addition, the lower portion of the lower tubular support member 20 is provided with a plurality of discrete circular apertures 24 disposed at spaced locations above yet proximate to the flanged collar 22 and a like plurality of outwardly projecting catch elements 25 vertically spaced above the circular apertures 24.

Furthermore, the intermediate portion of the lower tubular support member is provided with a first horizontally.aligned row of generally square apertures 26 which are dimensioned to receive a selected number of said plurality of potted plant support members 12.

Still referring to FIG. 2, it can be seen that the upper tubular support member 30 is likewise provided with a tapered bottom end 31 wherein the lower portion of the upper tubular support member 30 is further provided with a plurality of vertically aligned spring detent buttons 32 which are adapted to selectively engage and rest upon the flanged lip 23 of the lower tubular support member 20 as will be explained in greater detail further on in the specification.

In addition, the intermediate portion of the upper tubular support member 30 is provided with a second 33 and third 34 row of horizontally aligned generally square apertures which likewise are dimensioned to receive selected ones of the remaining plurality of potted plant support units 12.

As can also be seen by reference to FIG. 2, the open upper end 35 of the upper tubular support member 30 is dimensioned to receive a dish-shaped plate element 36 that will support the bottom of a suitably shaped potted plant (not shown); wherein the dish shaped plate element 36 is further provided with a plurality of bendable wire arms 37 that can be deformed to contact and frictionally engage the sides of an oversized potted plant to stabilize the oversize potted plant resting on top of the dish shaped plate element.

Figure 3:
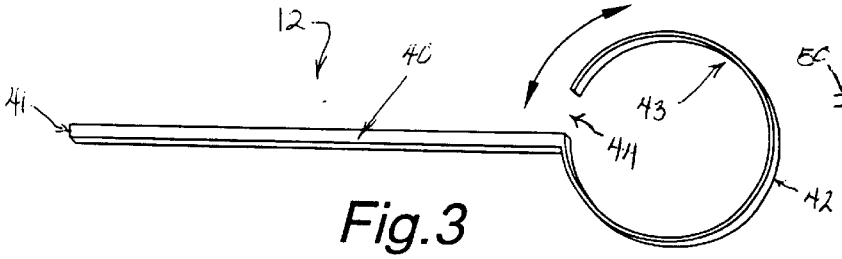
FIG. 3 is an isolated perspective view of one of the plurality of potted plant support units.

Turning now to FIGS. 1 and 3, it can be seen that each of the plurality of potted plant support units include an elongated rigid support arm member 40 having an inner end 41 provided with a generally square cross-sectional configuration that is dimensioned to be received in the generally square apertures in the first 26 second 33 and third 34 rows of apertures, and having an outer end 42 which terminate in a split ring pot receiving element 43 whose side opening 44 can be enlarged or reduced to accommodate the periphery of different sized potted plants.

As can also be appreciated by reference to FIG. 1, in the preferred embodiment of the invention, the relative length of the support arm members 40 decreases as the position of the support arm members 40 rises on the lower 20 and upper 30 tubular support members, to produce a generally three-shaped configuration for the potted plant holder 10 of this invention.

In addition, as shown in FIG. 1, the first row of apertures 26 can accommodate twelve elongated support arm members 40', the second row of apertures 33 can accommodate six intermediate length support arm members 40", and the third row of apertures 34 can accommodate three relatively short support arm members 40'". However, this is for illustration purposes only and the precise number of apertures in the respective rows of apertures as well as the corresponding number of support arm members can be varied in keeping with the teachings of this invention.

Returning once more to FIGS. 1 and 2, it can be seen that the stabilizing unit 13 comprises a plurality of stabilizing rod members 50 whose inboard ends are dimensioned to be received in the circular apertures 24 formed in the lower tubular support member 20 wherein the inboard end of each of the stabilizing rod members 50 are further provided with a prong element 51 that is dimensioned to be captively engaged by the catch elements 25 in the lower tubular support member 20.

In order to install the potted plant holder 10 at a desired location, the user would first force the pointed end 21 of the lower tubular support member 20 into penetrating engagement with the ground wherein the stabilizing rod members 50 could be stepped upon to drive the pointed end 21 further into the ground until all of the stabilizing rod members 50 are flush against the top surface of the soil.

At this juncture, the user would insert the upper tubular support member 30 into the lower tubular support member 20 at a desired height as dictated by the push button detents 32 and then insert the support arm members 40 according to length into the rows of apertures 26 33 34.

Once the potted plants bed been installed into the outboard ends 42 of the support arm members 40, the upper tubular support members 30 could be periodically rotated relative to the lower tubular support member 20 to evenly expose the potted plants supported on the upper tubular support member 30 to equal amounts of sunshine over a period of time.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A potted plant holder comprising:

a vertically adjustable main support unit including an upper tubular support member dimensioned to be telescopically received within a lower tubular support member;

a plurality of potted plant support units including a plurality of support arm members each having an inboard end adapted to be connected to a selected one of said upper and lower tubular support members, and an outboard end provided with a split ring pot receiving element having a side opening; and, a stablilizing unit operatively associated with said lower tubular support member and including a plurality of stabilizing rod members which project outwardly from said lower tubular support member.

2. The potted plant holder as in claim 1; further comprising means for varying the height of the vertically adjustable main support unit.

3. The potted plant holder as in claim 2; wherein, the upper tubular support member is rotatably supported within the lower tubular support member.

4. The potted plant holder as in claim 1; wherein, the side opening in the split ring pot receiving element is adapted to be expanded and contracted to accommodate potted plants having different circumferences.

5. The potted plant holder as in claim 1; wherein, the lower tubular support member has a bottom end which is tapered and an upper end which is provided with a flanged lip.

6. The potted plant holder as in claim 5; wherein, the upper tubular support member is provided with a plurality of vertically staggered push button detent elements that are selectively engagable with the flanged lip in the lower tubular support member.

7. The potted plant holder as in claim 1; wherein, both the upper and lower tubular support members are provided with at least one row of horizontally arrayed generally rectangular apertures.

8. The potted plant holder as in claim 7; wherein, each of the plurality of support arm members has an inboard end having a generally rectangular cross-sectional configuration which is dimensioned to be received in selected one of said rows of horizontally disposed generally rectangular apertures.

9. The potted plant holder as in claim 8; wherein, said plurality of support arm members includes one group of relatively long support arm members associated with the lower tubular support member and another group of relatively short support arm members associated with the upper tubular support member.

10. The potted plant holder as in claim 9; wherein, the upper tubular support member has an open upper end that is adapted to receive a dish-shaped plate element dimensioned to support the bottom of a potted plant.

11. The potted plant holder as in claim 10; wherein, the dish shaped plate element is further provided with a plurality of outwardly extending deformable wire arms adapted to engage the sides of a potted plant.

* * * * *